US007246703B1

(12) United States Patent
D'Aquisto

(10) Patent No.: US 7,246,703 B1
(45) Date of Patent: Jul. 24, 2007

(54) GUITAR STRING CASE

(76) Inventor: James D'Aquisto, 2315 Bent Tree Rd., Palm Harbor, FL (US) 34683

( * ) Notice: Subject to any disclaimer, the term of this patent is extended or adjusted under 35 U.S.C. 154(b) by 0 days.

(21) Appl. No.: 11/432,312

(22) Filed: May 11, 2006

(51) Int. Cl.
*G10D 3/10* (2006.01)
*B65D 85/675* (2006.01)
*B65D 71/50* (2006.01)

(52) U.S. Cl. ..... 206/314; 84/199; 84/329; 84/297 R; D3/303

(58) Field of Classification Search ..... 84/280, 84/290, 327, 329; 206/303, 314
See application file for complete search history.

(56) References Cited

U.S. PATENT DOCUMENTS 197,585 A * 11/1877 Ashman ..... 206/314
488,005 A * 12/1892 Griffith ..... 229/72
607,130 A * 7/1898 Rapp ..... 383/39
718,114 A * 1/1903 Pinney ..... 206/314
739,644 A * 9/1903 Boyle et al. ..... 206/303
943,202 A * 12/1909 Struss ..... 206/389
1,785,975 A * 12/1930 Phillips ..... 312/31
2,533,495 A * 12/1950 Moffett ..... 242/129
3,138,309 A * 6/1964 Hulterstrum ..... 225/59
3,231,215 A * 1/1966 Horine ..... 242/146
3,259,231 A * 7/1966 Romanowski et al. ..... 206/349
3,301,393 A * 1/1967 Regan, Jr. et al. ..... 206/409
3,352,416 A * 11/1967 Lo Duca ..... 206/314
D256,471 S 8/1980 Spercel
D267,410 S 12/1982 Spercel
D280,330 S 8/1985 Tanaka
4,623,063 A * 11/1986 Balkin ..... 206/408
4,664,260 A * 5/1987 Stokes ..... 206/386
4,696,218 A 9/1987 Hoshino et al.
4,844,373 A * 7/1989 Fike, Sr. ..... 242/588.1
4,866,911 A * 9/1989 Grindrod et al. ..... 53/432
4,886,162 A * 12/1989 Ambrogio ..... 206/710
4,974,789 A * 12/1990 Milburn ..... 242/159
5,228,565 A * 7/1993 Sinn ..... 206/63.3
5,263,585 A * 11/1993 Lawhon et al. ..... 206/388
5,284,306 A * 2/1994 O ..... 242/405
5,392,903 A * 2/1995 Sinn ..... 206/63.3
D360,528 S * 7/1995 Caligiuri ..... D3/303
5,465,643 A 11/1995 Beeson
5,477,764 A 12/1995 Carrico
5,704,473 A * 1/1998 Oster ..... 206/314
D392,796 S * 3/1998 North ..... D3/204
5,746,263 A * 5/1998 Koverola ..... 144/355
D408,099 S * 4/1999 Putnam ..... D27/190
5,913,257 A 6/1999 Schaller et al.
5,957,282 A * 9/1999 Juszkiewicz et al. ..... 206/314
D416,353 S * 11/1999 Fink ..... D27/133
6,109,005 A * 8/2000 Fogle ..... 53/430
D433,807 S * 11/2000 Vazquez ..... D3/303
6,427,832 B1 * 8/2002 Ali et al. ..... 206/303
D469,354 S * 1/2003 Curtsinger ..... D9/444
6,533,114 B1 * 3/2003 Gordon et al. ..... 206/232
6,561,345 B2 * 5/2003 Gordon et al. ..... 206/232
6,563,037 B2 5/2003 Hamilton
6,745,899 B1 * 6/2004 Barton ..... 206/409
6,857,521 B2 * 2/2005 Cantu-Gonzalez ..... 206/397
6,860,388 B2 * 3/2005 Boorman ..... 206/308.1
6,986,421 B2 * 1/2006 Allgood et al. ..... 206/54

* cited by examiner

*Primary Examiner*—Lincoln Donovan
*Assistant Examiner*—Robert W. Horn

(57) ABSTRACT

A packaging system for musical instrument strings comprising: a cylindrical disk-shaped casing comprising a top casing member and a mate-able bottom casing member; and at least one insertable string module, said module comprising a flat disk for supporting a wound string and a rim surrounding the outer periphery of the disk to support and hold the string on to the disk.

3 Claims, 9 Drawing Sheets

GUITAR STRING CASE

FIELD OF THE INVENTION

The present invention is directed to the field of guitar strings. In particular, the present invention is directed to the field of guitar boxes, packaging and cases.

BACKGROUND OF THE INVENTION

There are over 30 million guitar playing Americans. There are a significant number of guitar types. All of these share the feature of requiring strings. There have long been a significant number of guitar string-related technologies.

U.S. Pat. No. 6,563,037 discloses a tool for use with a guitar for establishing a proper degree of pre-tightening slack in each of a plurality of guitar strings attached to respective head and rear locations of the guitar and prior to final tightening and wrapping of the strings.

U.S. Pat. No. 5,465,643 discloses a guitar string support insert located between the saddle block of a guitar tremolo and each string passing over the saddle block which is held thereto by a string retaining screw operated device in order to reduce string breakage.

There have been a number of technologies directed to guitar string tuning and fastening technologies. These include systems such as those described in U.S. Pat. Nos. 4,696,218 and 5,477,764.

U.S. Pat. No. 5,913,257 comprises a method of manufacturing a guitar string. There have also been several design patents in the area of guitar string tuning devices and housings. These include U.S. Design Pat. Nos. D280,330; D267,410; and D256,471.

While there have been a significant number of technologies directed toward guitars, there have been no technological improvements in the areas of the packaging for the guitar strings themselves.

Most guitar strings are sold in simple rectangular cardboard boxes. The strings are frequently placed loose in the box in loops. This type of packaging arrangement can lead to the strings falling out of the box, getting lost, becoming misplaced, or becoming entangled.

There is a long felt need for a guitar string packaging arrangement which is more consistent and compatible with the looped manner in which the strings are manufactured. There is a further longstanding need to provide a packaging system in which the strings can be individually packaged in a separate packaging module.

It is an object of the present invention to provide a novel guitar string packaging system.

It is a further object of the present invention to provide a novel guitar string packaging system in which the guitar strings are individually packaged.

It is a further object of the present invention to provide a string packaging system which can be used for guitars and banjos.

It is a further object of the present invention to provide a guitar string packaging system in which the strings are packaged individually and packaged in a disk shaped container.

These and other objects of the present invention will become apparent from the detailed description which follows.

SUMMARY OF THE INVENTION

In accordance, the present invention discloses a packaging system for musical instrument strings; a cylindrical disk shaped casing comprising a top casing member and a mate-able bottom casing member; and at least one insertable string packaging module for holding a guitar string within the casing.

In a further embodiment of the present invention, the invention discloses a packaging system for musical instrument strings comprising a cylindrical disk-shaped casing comprising a top casing member and a mate-able bottom casing member; and at least one insertable string module, said module comprising a flat disk for supporting a wound string and a rim surrounding the outer periphery of the disk to support and hold the string on to the disk.

In still a further embodiment, this invention is a musical instrument string packaging system comprising a disk shaped casing comprising a first top casing member and a second mate-able bottom casing member; a plurality of string packaging modules for placement in the casing wherein the module comprises a disk shaped flat packaging module for holding a wound string; said disk having a rim surrounding the periphery of the disk to support the wound string and at least one lip extending from the rim to hold the string.

BRIEF DESCRIPTION OF THE PRESENT INVENTION

Figure 1:
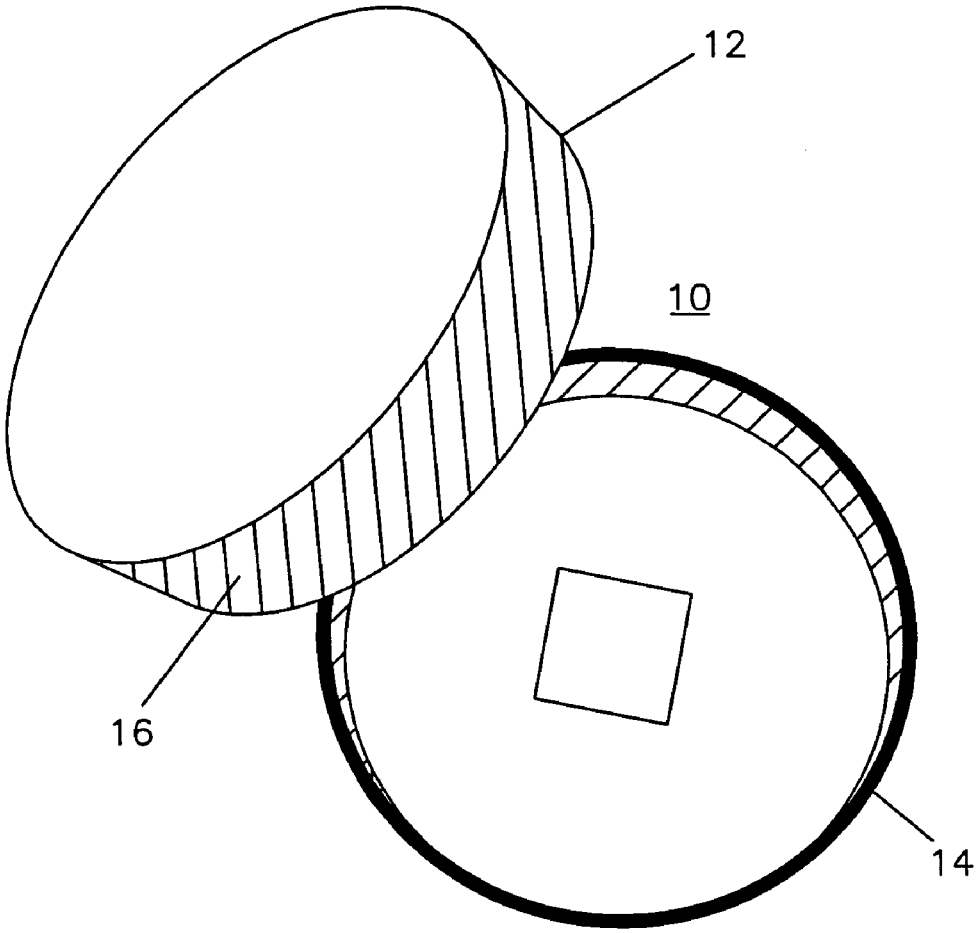
FIG. 1 is an overhead view of the novel guitar storing case design of the present invention.

The present invention is described with reference to the Figures wherein the same numbers are utilized where applicable. Referring to FIG. 1, the invention comprises a cylindrical disk shaped casing 10. The casing has a top cover 12 and a mate-able bottom cover 14. The casing has a side wall 16 which owns a cylindrical ring. The top cover 12 fits over the bottom cover 14 and forms a lid. The casing 10 may be constructed from a variety of materials, including plastics, paper, wood or metals.

Figure 2:
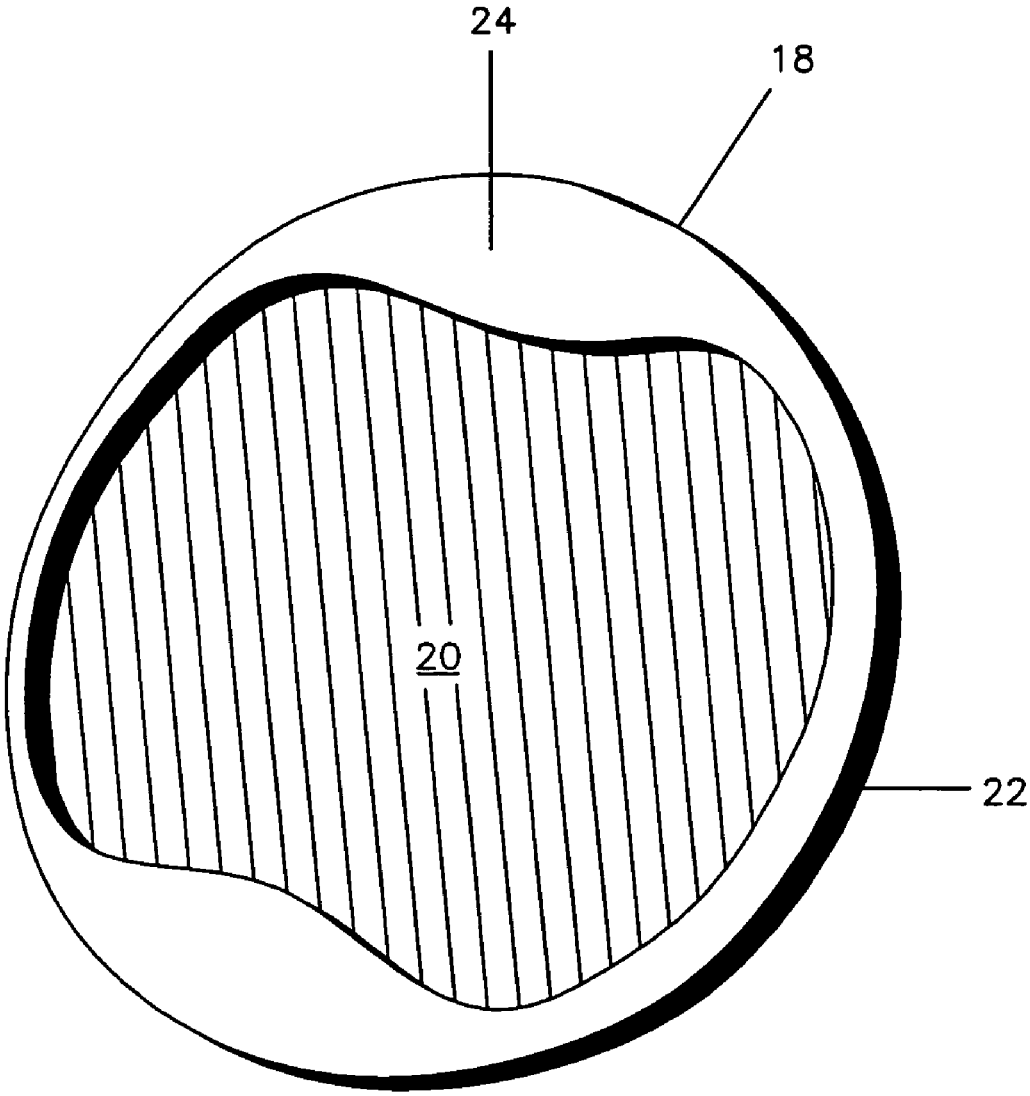
FIG. 2 is an elevational view of a first packaging module of the present invention.

As shown in FIG. 2, the casing 20 is designed to hold and store a plurality of guitar strings, each of which is secured in an individualized packaging module 18.

Figure 3:
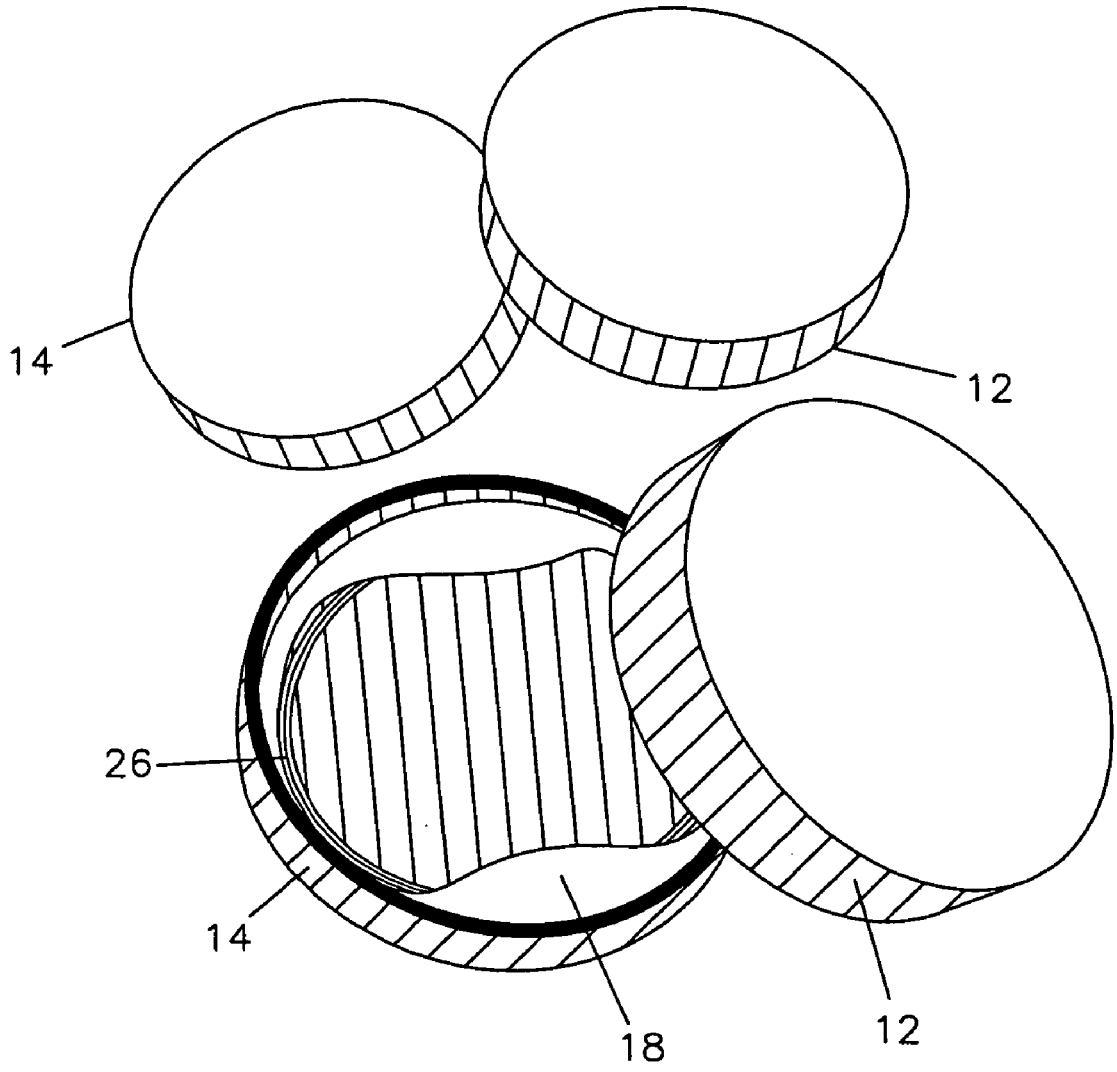
FIG. 3 reveals perspective views of the casings of the invention.
Figure 4:
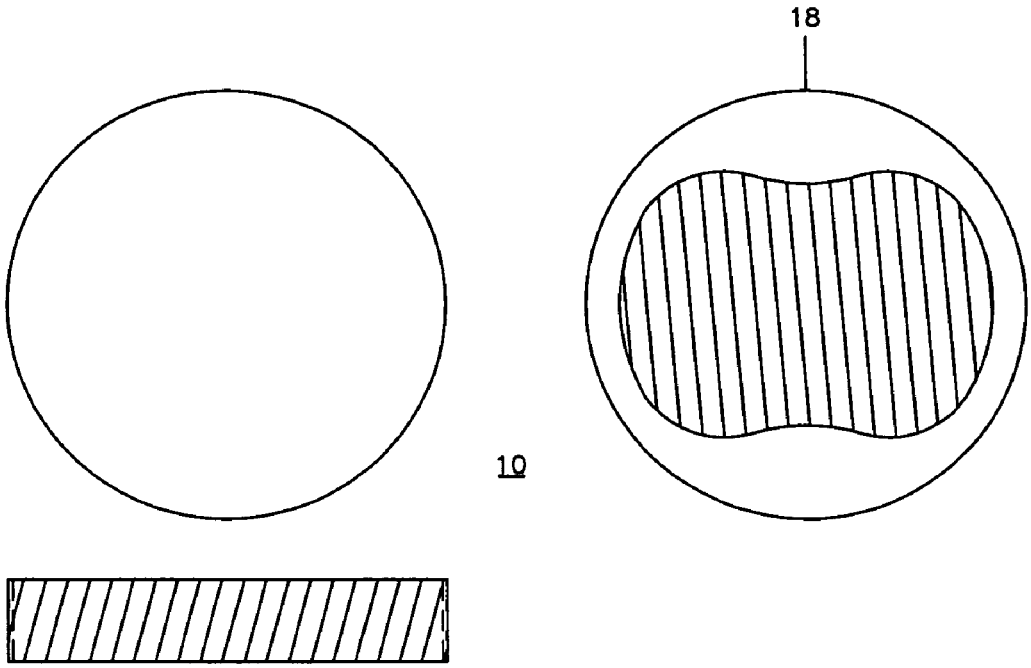
FIG. 4 is a perspective view of the casing and packaging module.
Figure 5:
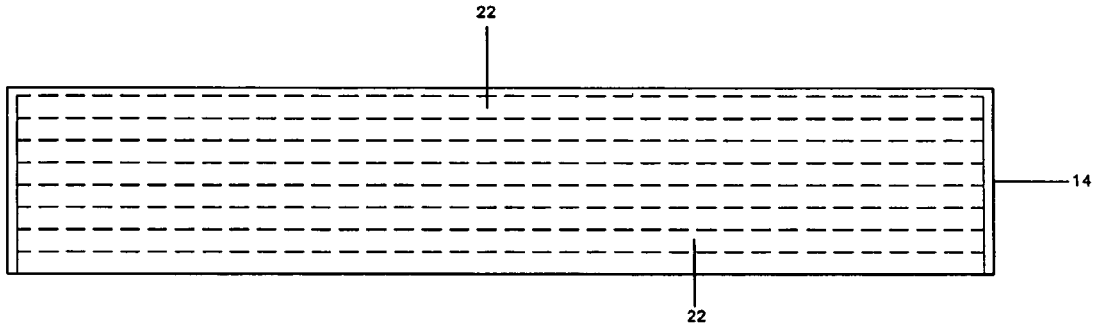
FIG. 5 is a sectional view of the casing with packaging modules, in accordance with the invention.
Figure 6:
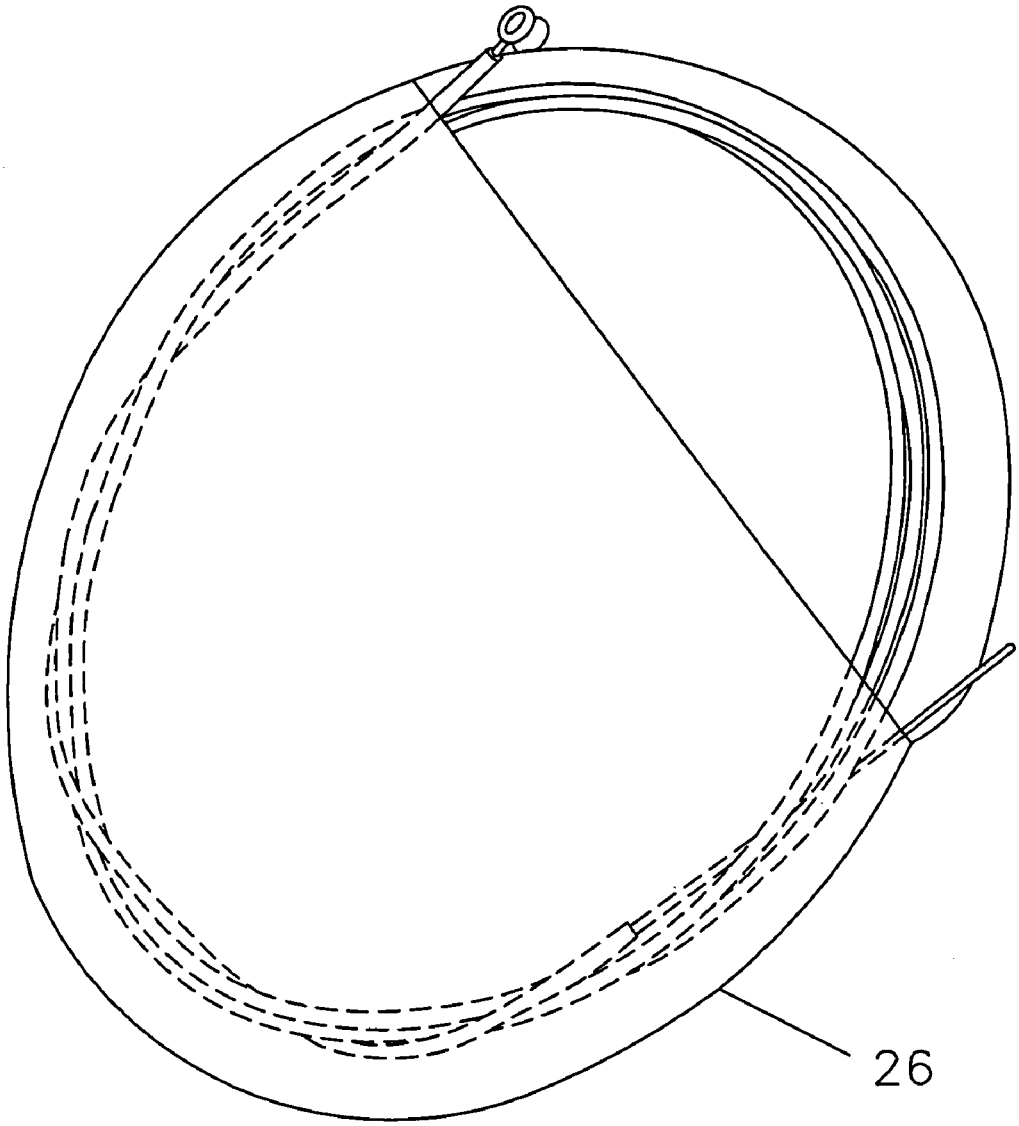
FIG. 6 is an alternative packaging module with a string.
Figure 7:
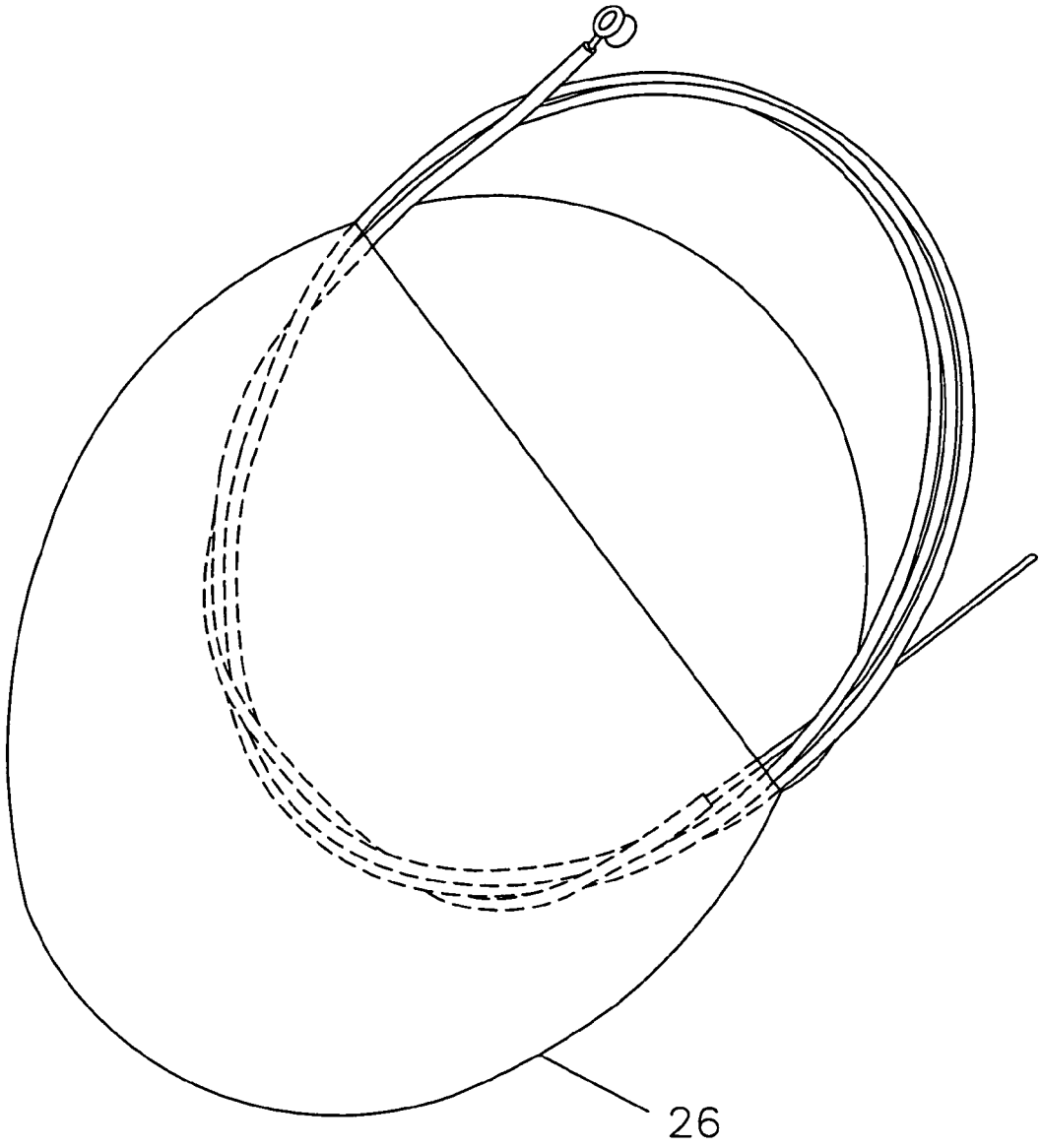
FIG. 7 is the alternative packaging module with strings being removed.
Figure 8:
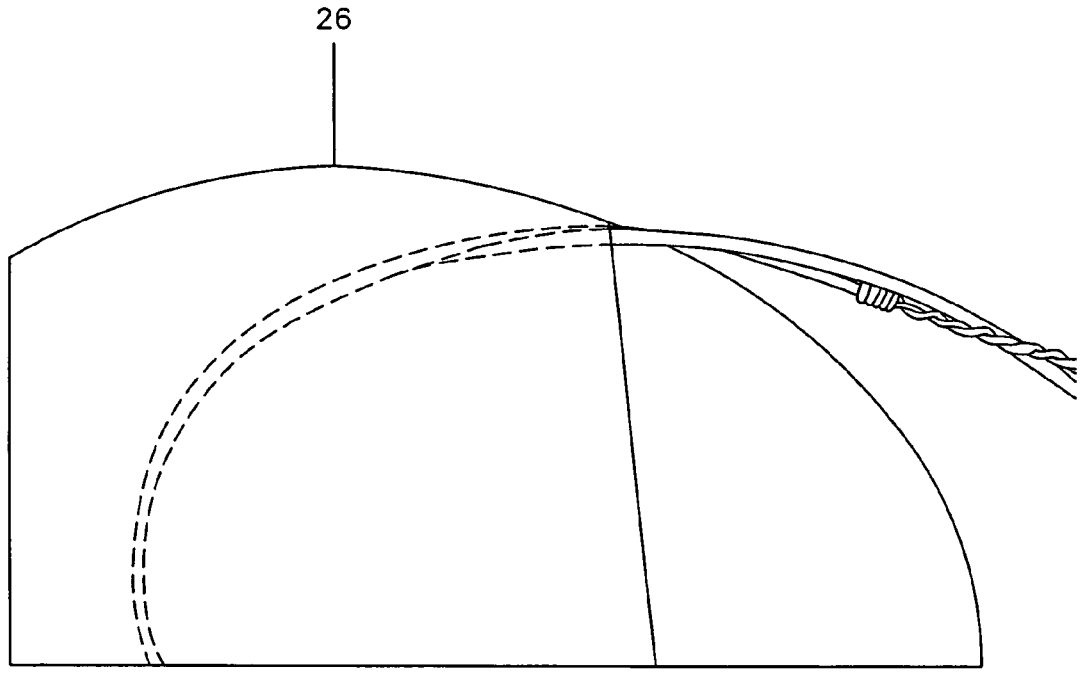
FIG. 8 is an isolated view of the string being removed from the packaging module.

The individually packaged module 18 in a preferred embodiment is a flat disk with a rim 22 which surrounds the outer periphery of the disk and which supports and holds a wound guitar string. The rim 22 forms two opposing lips 24 which surround the string. The lips hold and support each of the strings. FIG. 3 illustrates the packaging module for the strings 26 within the lower casing 14. FIG. 4 is a side perspective and overhead view of the casing 10 and the packaging module 18. As shown in FIG. 5, the box is shown as holding a plurality of string modules 22. The casing 14 can hold and support up to seven to eight string modules 22.

Figure 9:
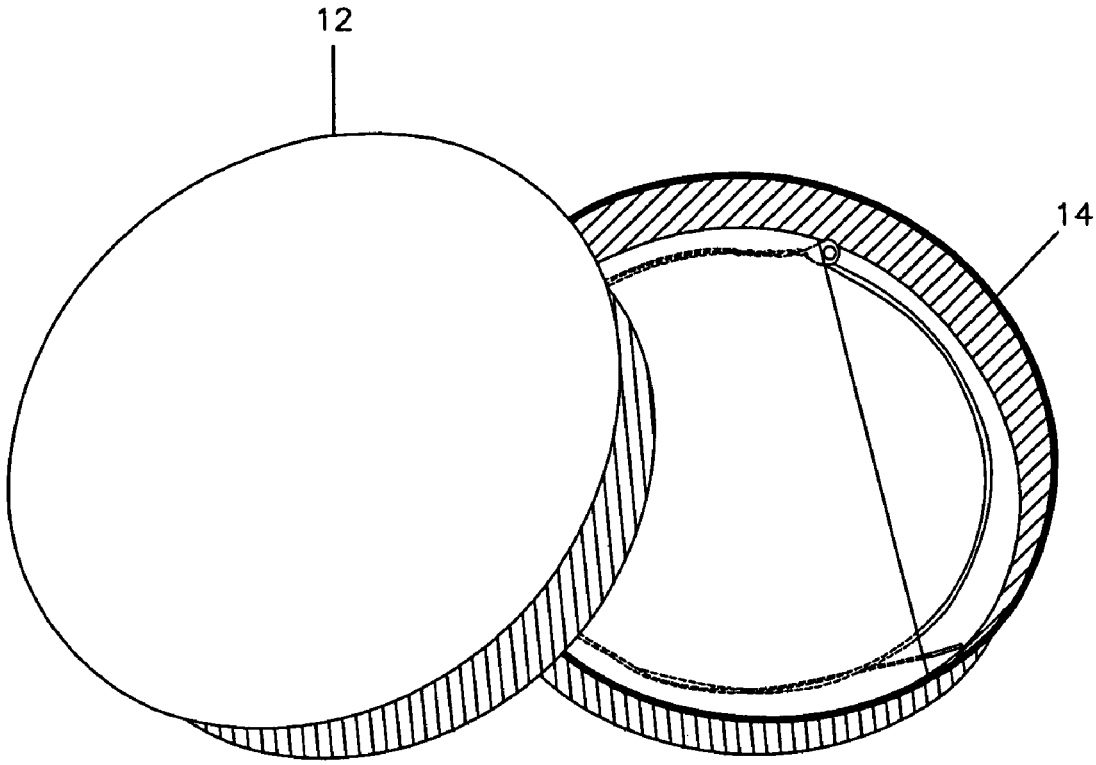
FIG. 9 is an overhead view of the alternative packaging module in a casing.

Referring to FIGS. 6 through 9, in an alternative embodiment, the module can comprise a plastic sleeve or envelope which holds an individual wound string. As shown in FIG. 9, the module is placed in the case.

The invention claimed is:

1. A musical instrument string packaging system comprising:

a disk shaped casing comprising a first top casing member and a second mate-able bottom casing member;

a plurality of string packaging modules for placement in the casing wherein the module comprises a disk shaped flat packaging module for holding a wound string;

each said string packaging module engages one coiled musical instrument string within a pocket configured on the module for sliding insertion/removal of said coiled string; and said disk having a rim surrounding the periphery of the disk to support the wound string and at least one lip extending from the rim to hold the string.

2. The packaging system of claim 1 wherein the musical instrument is a guitar.

3. The packaging system of claim 1 wherein the musical instrument is a banjo.

* * * * *